United States Patent [19]

Mimino et al.

[11] 3,957,545

[45] May 18, 1976

[54] AUSTENITIC HEAT RESISTING STEEL CONTAINING CHROMIUM AND NICKEL

[75] Inventors: Tohru Mimino; Kazuhisa Kinoshita; Takayuki Shinoda; Syuji Oki; Akira Nagao, all of Kawasaki, Japan

[73] Assignee: Nippon Kokan Kabushiki Kaisha, Tokyo, Japan

[22] Filed: Feb. 1, 1973

[21] Appl. No.: 328,694

Related U.S. Application Data

[63] Continuation-in-part of Ser. No. 58,895, July 28, 1970, abandoned, which is a continuation-in-part of Ser. No. 699,388, Jan. 22, 1968, abandoned.

[52] U.S. Cl. ..... 148/38; 75/128 G; 75/128 T; 148/136

[51] Int. Cl.[2] ..... C22C 38/48; C22C 38/50

[58] Field of Search ..... 75/128 T, 128 G; 148/38, 136

[56] References Cited

UNITED STATES PATENTS

| | | | |
|---|---|---|---|
| 2,190,486 | 2/1940 | Schafmeister | 75/128 G |
| 2,528,637 | 11/1950 | Clarke | 148/38 |
| 2,531,155 | 11/1950 | Phillips | 75/128 G |
| 3,235,417 | 2/1966 | Roy | 148/38 |
| 3,284,250 | 11/1966 | Yeo | 148/38 |
| 3,303,023 | 2/1967 | Dulis | 75/128 G |
| 3,306,736 | 2/1967 | Rundell | 75/128 G |
| 3,401,036 | 9/1968 | Dulis | 75/128 G |
| 3,607,239 | 9/1971 | Mimino | 75/128 G |
| 3,751,244 | 8/1973 | Mimino et al. | 75/128 G |

*Primary Examiner*—L. Dewayne Rutledge
*Assistant Examiner*—Arthur J. Steiner
*Attorney, Agent, or Firm*—Flynn & Frishauf

[57] ABSTRACT

Creep rupture strength of austenitic heat resisting steel containing chromium and nickel is improved by adding to the steel small amounts of niobium, a niobium-tantalum or a niobium-tantalum-titanium mixture, and maintaining a Nb/C ratio of less than 3.5.

2 Claims, 2 Drawing Figures

AUSTENITIC HEAT RESISTING STEEL CONTAINING CHROMIUM AND NICKEL

RELATED APPLICATION

This application is a continuation-in-part of application Ser. No. 58,895, filed July 28, 1970, which, in turn, is a continuation-in-part of application Ser. No. 699,388, filed Jan. 22, 1968. Each of said applications has been abandoned.

This invention relates to an improvement of austenitic heat resisting steel containing chromium and nickel, having high creep rupture strength at elevated temperature for a long time and a moderate price.

With the development of ultra critical pressure boilers, the boiler for thermal generation has been increasingly large-sized and operated under high pressure at high temperature. This is introducing new requirements for boiler tubes of greater strength at elevated temperatures. It is well-known in the art (e.g. U.S. Pat. No. 2,320,260) that the creep rupture strength of chromium-nickel, austenitic heat-resisting steel can be greatly improved by the addition of an alloying element, namely, niobium, amounting to about 6–10 times the carbon content in the steel. However, this steel, containing a substantial amount of niobium, is so expensive that it is not economically suitable to be used for boiler tubes for thermal generation or chemical tubes.

Niobium (columbium) alone or mixed with tantalum, in amounts preferably exceeding 10 times the carbon content of chromium-nickel, austenitic steels have also been described in U.S. Pat. No. 2,159,497.

Welding rods of high silicon content and having a columbium content of at least four times the carbon content thereof, are described by Franks in U.S. Pat. No. 2,067,630.

Austenitic stainless steels containing columbium and having high yield strengths, are described by Yeo et al in U.S. Pat. No. 3,284,250. The steels are prepared with a sequence of operations concluding with a final heat treatment (annealing) at tempertures as high as 2000°F. (1093°C.) for not greater than 5 minutes, and more advantageously at 1750°–1850°F. (954°–1010°C.) for 3 hours to 0.4 hour. The steels have an ASTM grain size number of 11 to 14 or finer and are said to be substantially free of coarse carbide precipitates.

On the other hand, the cheap chromium-nickel austenitic steels, not containing niobium or tantalum at all, have lower creep rupture strength, so that they are unsuitable for heavy boiler tubes for thermal generation or chemical tubes requiring high heat-resistance and pressure-resistance.

The present invention has its object to obtain relatively inexpensive chromium-nickel, austenitic heat-resisting steel having higher creep rupture strength enough to be used for boiler tubes for larger thermal generation or chemical tubes, characterized by steel containing 0.03%–0.20% carbon, 15.5%–21.0% chromium, 7.0%–14.0% nickel, less than 1% silicon, and less than 2% manganese, with the addition of 0.005%–0.30% niobium or a niobium-tantalum mixture, or less than 0.10%. titanium mixed with said niobium or said niobium-tantalum mixture, and having a niobium/carbon ratio of less than about 3.5.

According to the present invention, the creep rupture strength at highly elevated temperatures can be greatly improved to about 1.5–2.0 times of that for steels not containing said addition elements. Moreover, compared with conventional austenitic heat-resisting steel, the price is quite moderate, because satisfactory results can be obtained by the small additions of expensive niobium and tantalum.

As mentioned earlier, it is already well-known that the creep rupture strength of heat-resisting steel can be greatly improved by the addition of alloying elements, such as niobium or a niobium-tantalum mixture in quantity of 6–10 times of the carbon content. Further, it has been taken in the prior art for granted that the addition of a smaller quantity is not enough to improve the characteristics of heat-resisting steel. This present invention is based on a discovery by many experiments that the most satisfactory results for heat resistance may be attained with smaller amounts, as mentioned above, of said elements combined with specified heat treatment.

As indicated above, relatively small amounts of niobium or of niobium-tantalum mixtures, with or without small amounts of titanium, are used in the steels of this invention, and the niobium/carbon ratio is maintained at less than about 3.5, and preferably less than 3. Although niobium is beneficial in regard to grain refining of steel crystals and in preventing precipitation of carbon at high temperatures, relatively high Nb/C ratios, as 6–10, are prone to carbide formation, such that creep rupture strength deteriorates due to roughened carbide at high temperatures. In order to avoid such problems and yet realize high creep rupture strength at high temperature, the Nb/C ratio should be below about 3.5. Further improvement is realized with small amounts of tantalum (present in unrefined niobium) and titanium. The added elements react in the utilization of the steel at high temperatures to prevent precipitation and roughening of carbide; they also provide uniform and refined dispersion of carbide. All of this leads to improved creep rupture strength at high temperatures.

In the present invention, the reason to fix the range in steel composition as mentioned above is due to the following considerations. Carbon content about 0.20% makes it carbide produce easily, and results in reducing the strength owing to rise of its carbide cohesion rate, while below 0.03%, increase of the strength by solid solution of carbon cannot be expected. Chromium is not beneficial in amounts of more than 21.0%, because the appearance of delta ferrite decreases the creep rupture strength at elevated temperature; below 15.5%, its oxidation-resistance, as the austenitic steel, is not adequate enough. Nickel is not economically desirable in amounts above 14%; below 7%, the non-uniformity of austenitic phase is shown by the appearance of delta ferrite. The steel, with the addition elements of niobium or a niobium-tantalum mixture in an amount of less than 0.005%, has no high creep rupture resistance; above 0.30%, the price of steel becomes too high to put it to practical use.

Silicon can be present in amounts of less than 1.00 percent by weight for deoxidation purposes. Manganese can be present in amounts of less than 2.00 percent by weight for the same purposes and to improve hot working properties of the steels.

Proper heat treatment, namely, solution treatment for final processing at a temperature higher than 1050°C., is needed combined with the proper chemical compositions mentioned above to obtain high creep rupture strength. This is explained hereinbelow.

The creep rupture strength of steels with added niobium or a niobium-tantalum mixture is further improved by the addition of titanium. However, the addition of greater than 0.10% of titanium makes titanium carbides produce easily, which makes the carbide particles coarsen, undersirably resulting in decrease of the said strength at elevated temperature for a long time. It is difficult to improve creep rupture strength by addition of less than 0.005% of titanium. At the same time, the creep rupture strength of steels, with added titanium only in said amount, increases slightly. However, the degree of its increase may be quite meaningless. Compared with the ordinary austenitic steels like SUS 27 steel according to JIS (Japan Industrial Standard) specifications, the austenitic heat-resisting steels according to the present invention have about 1.5–2.0 times higher strength at elevated temperature and little higher manufacturing cost. Accordingly, the steel according to the present invention is most suitable for heavy boiler tubes for thermal generation and chemical tubes operated under high pressure at elevated temperatures which are expected to be on a larger scale in the future.

In contrast to prior austenitic chromium nickel alloy steels containing niobium, the steels of this invention need not and do not include beyond the unavoidable extent one or more of such elements as: aluminum, nitrogen, molybdenum, vanadium, zirconium, copper and boron.

Steels according to the present invention are considered to be similar to SUS 27 steel specified by its basic constituents in said JIS. Table 1 shows the creep rupture strength of said SUS 27 steel.

Table 1

| temperature | Creep rupture strength of SUS 27 steel (solution treated at 1100°C.) 600°C. | | 650°C. | | 700°C. | |
|---|---|---|---|---|---|---|
| time (hour) | $10^3$ | $10^4$ | $10^3$ | $10^4$ | $10^3$ | $10^4$ |
| creep rupture strength (kg/mm²) | 15.1 | 10.8 | 10.2 | 7.3 | 7.0 | 4.9. |

As apparent from Table 1, the creep rupture strength of SUS 27 steel is undesirably low, so that there has been a demand to increase the strength. But from an economic point of view, said SUS 27 steel is the cheapest among the austenitic steels now put to practical use.

Therefore, one of the purposes of the present invention is to provide an improved austenitic heat-resisting steel without increasing the cost.

Another object is to provide an austenitic heat-resisting steel having the best creep rupture strength based on a relatively small addition of some elements.

The foregoing and other objects of the invention will be apparent from the following detailed description taken in accordance with the accompanying drawings, in which.

EXAMPLE 1

Table 2 indicates the chemical composition of steels used in the example.

Table 2

| kinds of steel | Chemical composition of steels (%) by weight) elements C | Si | Mn | Cr | Ni | Nb | Nb/C |
|---|---|---|---|---|---|---|---|
| No. 1 | 0.09 | 0.48 | 1.43 | 18.25 | 9.45 | 0.005 | 0.06 |
| No. 2 | 0.10 | 0.46 | 1.43 | 17.82 | 9.45 | 0.080 | 0.8 |
| No. 3 | 0.12 | 0.58 | 1.50 | 15.59 | 11.56 | 0.280 | 2.3 |

Figure 1:
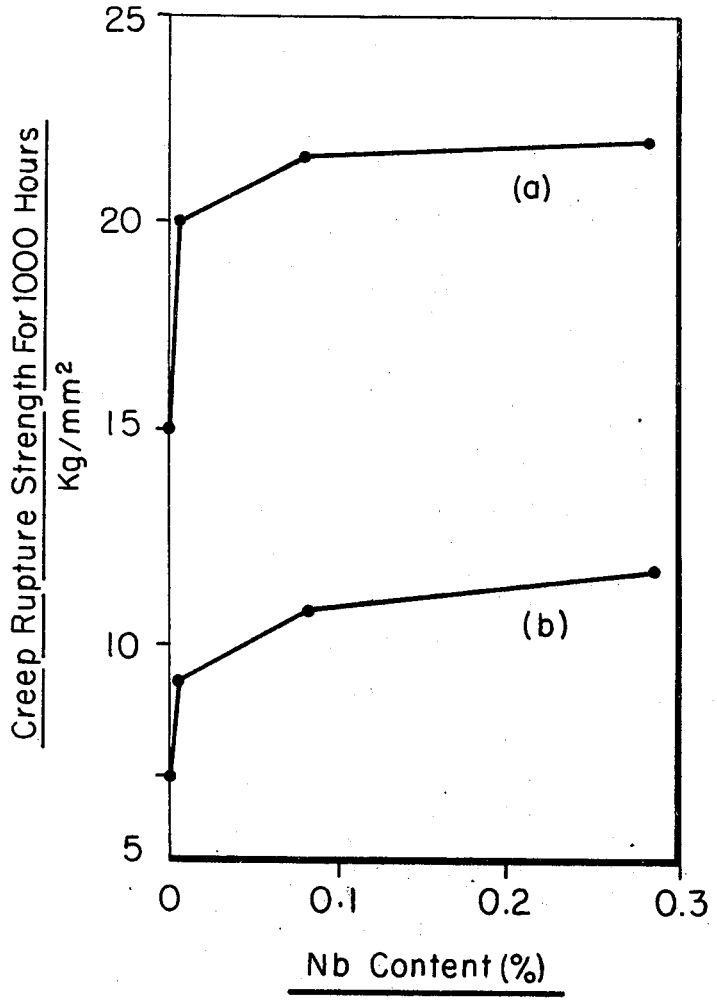
FIG. 1 is a graph illustrating the general change X of creep rupture strength under some elevated temperatures for 1,000 hours. X, which depends on Nb or Nb-Ta content.

FIG. 1 shows the general change of creep rupture strength of said three kinds of steel for 1,000 hours, which have been solution treated at 1100°C. for half an hour. As clearly shown in FIG. 1, with no addition of niobium, the creep rupture strength is low as shown in Table 1, but small additions of niobium drastically increase the strength, involving almost no change up to about 0.3%. Therefore, it has been confirmed very effectively as shown in Table 3, to add the small amount of niobium to steels containing 15.5%–21% chromium and 7%–14% nickel. (In said FIG. 1, curve (a) shows results at 600°C. and curve (b) at 700°C.).

Table 3.

| temperature / kinds of steel | Creep rupture strength, kg/mm², of steels experimented for 1,000 hours. 600°C. | 700°C. |
|---|---|---|
| No. 1 | 20.0 | 9.2 |
| No. 2 | 21.5 | 10.8 |
| No. 3 | 22.0 | 11.7 |

EXAMPLE 2

It has been found that the steel containing 0.01%–0.30% niobium can have higher creep rupture resistance by adding less than 0.1% titanium. Table 4 shows the chemical composition of the steels employed. (No. 4 steel is an ordinary steel, compared with steels according to the present invention.)

Table 4.

| Kinds of steel | Chemical composition of steels (% by weight) elements C | Si | Mn | Cr | Ni | Nb | Ti | Nb/C |
|---|---|---|---|---|---|---|---|---|
| No. 4 | 0.12 | 0.74 | 1.28 | 20.55 | 9.16 | — | 0.02 | — |
| No. 5 | 0.12 | 0.72 | 1.14 | 20.37 | 9.27 | 0.020 | 0.02 | 0.17 |
| No. 6 | 0.12 | 0.60 | 1.20 | 20.28 | 9.16 | 0.098 | 0.02 | 0.8 |

Figure 2:
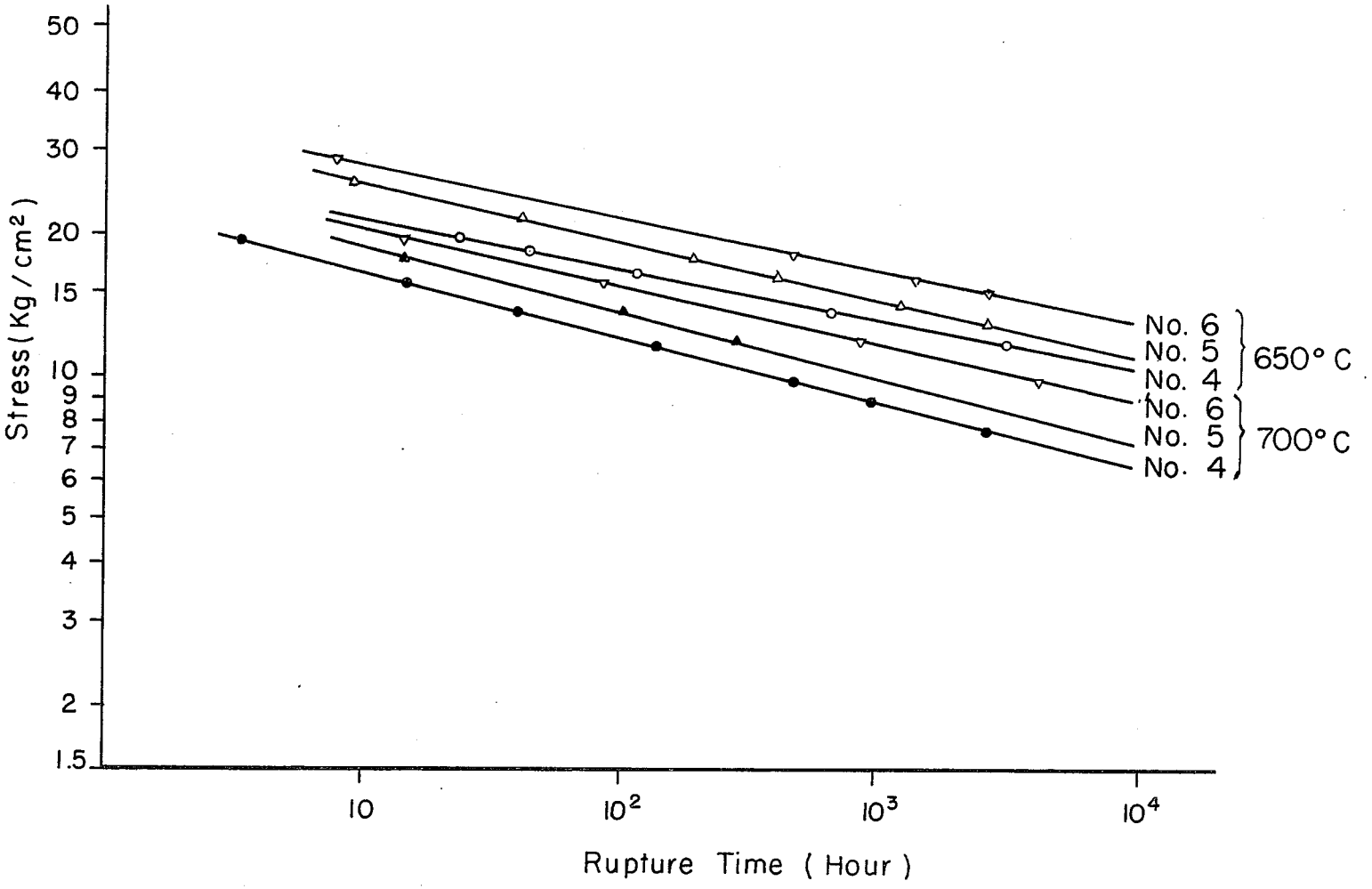
FIG. 2 shows the relation between stress and rupture time in comparison with ordinary steels.

FIG. 2 shows the creep rupture strength curves of No. 4 – No. 6 steels, which have been solution treated at 1100°C. for half an hour, at 650°C. and 700°C.

Table 5 shows the creep rupture strength at 650°C. and 700°C.

Table 5.

| temperature | Creep rupture strength of steels, (kg/mm²) 650°C. | | 700°C. | |
|---|---|---|---|---|
| time (hours) | $10^3$ | $10^4$ | $10^3$ | $10^4$ |
| No. 4 | 13.5 | 10.3 | 9.0 | 6.6 |
| No. 5 | 14.5 | 11.0 | 10.0 | 7.4 |
| No. 6 | 17.0 | 13.0 | 12.0 | 9.0 |

It is apparent that with added titanium only, the creep rupture strength is not so high as with the addition of titanium mixed with niobium.

As clearly indicated in the above description, small additions of titanium and niobium greatly increase the said strength at elevated temperature; an especially remarkable increase is noted at 700°C., that is about twice of that for SUS 27 steel (Table 1).

This type of austenitic heat resistant steel is ordinarily subjected to solution heat treatment in a final process irrespective of hot or cold rolling, in consideration of cold workability at the normal temperature. Solution heat treatment is also employed in order to remove the possibility of stress corrosion cracking and to maintain sufficient high strength of the steel for use at high temperatures. Austenitic crystal grains are very important for high temperature strength. It is well known in the art that steels having rough crystal grains possess high temperature strength. In consideration of this fact, ASTM standards provide for high solution temperatures of above 2000°F. (1093°C.) with respect to cold finished products, and above 1925°F. (1052°C.) with respect to hot finished products, for austenitic steels to be used at high temperatures (especially austenitic steels containing Ti or Nb). The lower temperature limit for hot finished products is low because grain sizes do not grow fine due to hot rolling.

By means of heat treatment, it is possible to control grain sizes of austenitic stainless steels subjected to cold rolling after hot rolling with a sufficient reduction rate.

EXAMPLE 3

Test pieces are steels typical of this invention and having chemical compositions shown in Table 6. They are subjected to cold rolling with a reduction rate of 30% after hot rolling. The test pieces were subjected to heat treatment at various temperatures and austenitic crystal grains of the same were examined. Then, the test pieces were subjected to a creep rupture test at 650°C.

Table 6.

| | Chemical Composition of the Test Piece (% by weight) | | | | | | |
|---|---|---|---|---|---|---|---|
| No. | C | Si | Mn | Cr | Ni | Ti | Nb |
| 7 | 0.11 | 0.54 | 1.50 | 17.88 | 9.92 | 0.03 | 0.14 |
| 8 | 0.15 | 0.58 | 1.51 | 17.96 | 9.98 | 0.07 | 0.22 |

Temperatures at which heat treatment was conducted, crystal grain sizes and 10,000 hour creep rupture strength at 650°C., are shown in Table 7.

Table 7.

| Correlation among heat treatment temperatures, crystal grain sizes and creep rupture strength. | | | |
|---|---|---|---|
| Steel No. | Heat treatment temperature* (°C.) | Crystal grain sizes (ASTM No.) | 650°C., $10^4$ hr. creep rupture strength (Kg/mm²) |
| | 950 | 10.0 | 7.6 |
| 7 | 1100 | 6.5 | 11.9 |
| | 1200 | 4.8 | 13.0 |
| | 950 | 9.5 | 7.8 |
| 8 | 1100 | 7.0 | 12.2 |
| | 1200 | 4.6 | 11.7 |

*The steels are maintained at the respective temperatures for 30 minutes and then cooled with water.

As shown in Table 7, when the heat treatment temperature is 950°C., crystal grain sizes are as fine as ASTM No. 9.5 – 10.0 and creep rupture strength is very low. This is because solid solution of elements is not sufficient at this temperature. The creep rupture strength is scarcely different from the 10,000 hour creep rupture strength at 650°C. of a SUS 27 steel shown in Table 1. Therefore, in order to effectively maintain high temperature strength, a combination of proper chemical composition and proper heat treatment is required. It is understood from the results of the test that it is desirable to adopt a heat treatment temperature (solid solution temperature) of above 1050°C. and an austenitic crystal grain size of ASTM No. 8 or rougher.

When a product is used as it is hot rolled, it is not always necessary to subject the same to a solution heat treatment; when grain size of the hot rolled product is ASTM No. 8 or rougher than that, solution heat treatment may be omitted.

The 10,000 hour creep rupture strength at 650°C. of the heat resistant steels is at least about 10 Kg/mm² in view of normal scattered band. If a steel has a lower strength, it is regarded as unsuitable for the purposes of this invention.

When the austenitic grain size is too large, i.e. less than ASTM No. 3, cold workability of the steel deteriorates and creep rupture elongation deteriorates considerably. Accordingly, austenitic grain sizes of ASTM Nos. 3–8 are desirable.

Although certain particular examples of the invention are herein disclosed for purposes of explanation, various further modification thereof, after study of this specification, will be apparent to those skilled in the art to which the invention pertains. References should accordingly be had to the appended claims in determining the scope of the invention.

The relation between the temperature and the length of time for solution treatment is as follows:

In order to obtain ASTM No. 8 or coarser austenitic grain size, it is necessary to maintain the steel for more than 30 minutes at 1050°C or for more than 5 minutes at 1100°C. In this way, the minimum length of time required for maintaining the steel at an elevated temperature becomes shorter as the solution treatment temperature is raised. However, it is not allowed to raise said temperature beyond 1300°C, because any control over the maintenance time cannot prevent the austenitic grains from growing excessively coarse at so high temperatures, making it impossible to secure ASTM No. 3 or finer austenitic grain size, that is to say, grain size in the range from No. 3 to No. 8.

What is claimed is:

1. In an austenitic heat resistant steel which has been subjected to solution heat treatment at a temperature of at least 1050°C. in a final step, the improvement which comprises a steel consisting of, in weight percent:

| | |
|---|---|
| C | 0.03 – 0.20 |
| Cr | 15.5 – 21.0 |
| Ni | 7.0 – 14.0 |
| Nb or Nb ± Ta | 0.005 – 0.30 |
| Si | less than 1.00 |
| Mn | less than 2.00 |
| Ti | less than 0.10 |
| Fe and unavoidable impurities | balance |

Nb/C < 3.5, said steel having been subjected to a solution temperature of from 1050°C. for at least 30 minutes or from 1100°C. for at least 5 minutes, to 1300°C., thereby having an austenitic crystal grain size, ASTM, within the range of from No. 3 to No. 8.

2. A steel of claim 1 containing from 0.005 to less than 0.10 percent by weight of titanium.

* * * * *